US008312717B2

(12) United States Patent
Hoffman et al.

(10) Patent No.: US 8,312,717 B2
(45) Date of Patent: Nov. 20, 2012

(54) EXTERNALLY HEATED ENGINE

(75) Inventors: Gary P. Hoffman, Middlesex, NY (US); Richard J. Ide, Middlesex, NY (US)

(73) Assignee: Renewable Thermodynamics, LLC, Middlesex, NY (US)

( * ) Notice: Subject to any disclaimer, the term of this patent is extended or adjusted under 35 U.S.C. 154(b) by 833 days.

(21) Appl. No.: 12/470,539

(22) Filed: May 22, 2009

(65) Prior Publication Data

US 2009/0255249 A1 Oct. 15, 2009

Related U.S. Application Data

(63) Continuation-in-part of application No. 11/446,951, filed on Jun. 5, 2006, now Pat. No. 7,762,055, which is a continuation of application No. 11/198,681, filed on Aug. 5, 2005, now Pat. No. 7,076,941.

(51) Int. Cl.
*F01B 29/10* (2006.01)

(52) U.S. Cl. ..... 60/517; 60/526

(58) Field of Classification Search ..... 60/39.2, 60/517–526

See application file for complete search history.

(56) References Cited

U.S. PATENT DOCUMENTS

| | | | | |
|---|---|---|---|---|
| 3,782,859 | A * | 1/1974 | Schuman | 417/207 |
| 3,861,146 | A * | 1/1975 | Lynch et al. | 60/524 |
| 3,939,657 | A | 2/1976 | Postma et al. | |
| 4,389,844 | A * | 6/1983 | Ackermann et al. | 60/517 |
| 4,498,298 | A * | 2/1985 | Morgan | 60/525 |
| 4,722,188 | A | 2/1988 | Otters | |
| 5,174,116 | A * | 12/1992 | Ishikawa | 60/520 |
| 6,945,044 | B2 | 9/2005 | Gimsa | |
| 7,076,941 | B1 * | 7/2006 | Hoffman et al. | 60/643 |
| 7,762,055 | B2 * | 7/2010 | Hoffman et al. | 60/39.6 |

* cited by examiner

*Primary Examiner* — Hoang Nguyen
(74) *Attorney, Agent, or Firm* — Harris Beach PLLC; Neal L. Slifkin

(57) ABSTRACT

An externally heated engine is provided which has a piston and a displacer. The position of the piston can be adjusted by a yoke and disk assembly on one end of a link and spacers and gaskets in the cylinder. The relative position of the displacer with respect to the piston can be changed by changing the relative position of a pair of disks in the crankshaft assembly. The displacer is caused to reciprocate by a link which is moved by a displacer cam assembly. The displacer cam assembly includes a first cam and a second cam. The first cam and the second cam each have a groove path. The displacer link follows the groove path of the cams to cause the displacer to dwell at the two ends of its stroke and to move rapidly from one end to the other.

14 Claims, 10 Drawing Sheets

EXTERNALLY HEATED ENGINE

RELATED APPLICATIONS

This application is a continuation in part of U.S. application Ser. No. 11/446,951, filed Jun. 5, 2006, which is a continuation of U.S. Pat. No. 7,076,941 the disclosures of which are hereby incorporated by reference herein.

TECHNICAL FIELD

The present invention relates to externally heated engines. More particularly, the present invention relates to improvements in the efficiencies of externally heated engines operating at relatively low temperatures and pressures.

BACKGROUND OF THE INVENTION

Externally heated engines and, in particular, Stirling cycle engines have always held great promise, because their theoretical thermal efficiency approaches that of the Carnot Cycle. This efficiency is established in turn by the difference between the hot and cold temperatures of the cycle. Recent designers of such engines have sought to maximize efficiency by increasing the temperature of the hot side of the engine. In addition, they have utilized fine molecule gasses, such as helium and hydrogen, at very high pressures, to further optimize the power output of the engine. Their combined efforts have resulted in commercial failure. The high temperatures have required the use of materials which can withstand these temperatures. The practical problems, and enormous expense, of using materials such as titanium and special alloys of stainless steels have combined to make the engines impractical to manufacture, and expensive to own and operate. High pressure gasses and extreme temperatures have made the engine so complex that it has been placed out of the reach of all but the most sophisticated users.

The present invention takes a completely opposite approach. Through the combined use of several innovations, the design of a high efficiency, low temperature, simple engine becomes possible.

To overcome the inefficiencies of engines of the past, the temperature differential between the air outside the cylinder, and the working fluid inside the cylinder must be very large to force the transfer of the necessary amount of heat in the very limited time available. This in turn forces the heat source itself to operate at an even higher temperature, and to be very tightly coupled to the heat exchanger. This tends to expose the external portions of the exchanger to even higher temperatures, which requires still more exotic materials.

An additional problem in the prior art engines concerns the temperature of the air sent to the regenerator. The extreme temperatures traditionally involved in the prior art make the use of common low temperature tubing, such as copper, impossible. This also applies to the materials used in the regenerator. Neither the outside of the regenerator or the material used in the regenerator matrix can be optimized for thermal performance, because the overriding concern is survivability at high temperature.

The problems of high temperatures completely dominate the design of a regenerator to be used in the prior art Stirling engines. This leads to significant thermodynamic losses, as well as greater expense, and reduced lifespan. The outside shell of the regenerator has to be made of high strength metals that will tolerate the high temperatures. This leads to high losses of heat to the environment, heat gained from the environment, and heat conducted from one end of the regenerator to the other. This heat conduction forces operation of the regenerator in a manner that is far from ideal.

The heat exchanger on the cold cylinder must efficiently remove heat from the working fluid, during the compression stroke. As with the hot side, prior art heat exchanger designs have used either the basic cylinder shape itself as the heat sink, or they have used simple finned surfaces or some variation of the shell and tube heat exchanger. In all such designs, the thermal resistance inherent in these approaches forces the heat sink to operate with a large difference in temperature ($\Delta T$) between the interior and exterior of the cylinder.

In other words, the working fluid inside the cold cylinder is forced to be at a temperature considerably above the outside temperature at which the heat is finally dissipated. This greatly reduces the $\Delta T$ across the engine, which limits the maximum efficiency and power output of the engine.

Since the Stirling Cycle is a closed thermodynamic cycle, the working fluid must be sealed inside the engine. This leads to several major design problems.

First, the prior art engines are forced to operate at high temperatures and pressures. This places great demands on the seals. To survive the high temperatures and pressures, the only practical approach has been to use sealing rings on the piston, as in conventional internal combustion engines. The piston and ring assemblies suffer leakage, or blow-by. This fluid loss from the engine is a critical problem, as it must continually be replaced to avoid loss of power output, and it disturbs the cycle. This usually means that the crankcase itself must be sealed as well, leading to problems of lost work in the crankcase, as the pistons do unwanted work on the crankcase gas. It also means that the crankcase must be filled with the same working fluid as used in the engine itself.

The piston rings scraping up and down on the walls of the cylinder lead to further problems. The biggest of these is the friction created. In a typical engine this can consume some 20% of the engine's output, a very serious loss.

A further problem is that of lubrication. Liquid oils cannot be simply sprayed onto the cylinder walls, as this would leak into the working area of the engine and contaminate the working fluid. This would lead to problems involving unwanted contamination, corrosion, and loss of efficiency. But without adequate lubrication, the friction losses become even greater.

Another problem with engines of the past is that a large proportion of the working fluid does not move fully throughout the engine. An engine is needed which increases the amount of working fluid which participates in the process.

Additionally, an engine is needed which has a variable compression ratio to allow for maximizing the power output depending on the temperature of the heat source used to power the engine. An engine is also needed which has variable timing to optimize power output at various temperature, pressure and engine speed conditions.

The present invention solves all these problems found in the prior art designs.

SUMMARY OF THE INVENTION

Briefly described, the present invention includes an externally heated engine having a piston and a displacer. A piston reciprocates within a first cylinder. The piston has a first side (working side) and a second side opposite the first side. The first side of the piston and the first cylinder define a working chamber containing working fluid, which may consist of any usable gas. The second side of the piston and the first cylinder define an opposite chamber containing an opposing fluid.

A displacer reciprocates within a second cylinder. A heater heats the working fluid in the hot chamber of the cylinder of the displacer. Preferably, the chamber is heated by a heat source so that the working fluid has a temperature of no more than 500° Fahrenheit with a temperature difference between the heat source and the working fluid of less than 5° Fahrenheit. It is possible to generate useful energy with working fluid temperatures of less than 212° Fahrenheit. One source of heat is the cooling pools of spent nuclear fuel, which are below 212° Fahrenheit. Currently, this potential source of energy is released to the atmosphere and not used. The working fluid may be heated with a heat exchanger or heat injector. Heated fluid is delivered to the heat injector and flows through grooves around thermally conductive material, thus injecting heat directly into the engine. The heat is trapped inside the engine by the thermally insulating material. The working fluid flows in the longitudinal direction through the thermally conductive material. The thermally conductive material has passageways so that the working fluid may pass longitudinally through it. The longitudinal passages for the working fluid are narrow and run the entire-useable length of the heat injector.

Preferably, the heat injector has grooves for the heated fluid which include multiple, parallel grooves which form a spiral or helical pattern along the entire outside useable length of the heat injector. The spiral grooves could be in sets of 2, 3, 4 or more, running parallel to one another and into which the heated fluid is injected simultaneously. By keeping these grooves very narrow and deep, a very high value of length to depth and thus low temperature differential is achieved, while providing adequate useable cross-sectional area to permit a sufficient volume of heated fluid to flow and provide heat input. The temperature difference between the heating fluid and the metal of the heat exchanger will be only about 5 degrees Fahrenheit.

Preferably, the engine includes a diaphragm associated with the piston to separate the working chamber from the opposing chamber. The diaphragm provides many benefits as will be described in detail below. Because of the use of the diaphragm, it is beneficial to control the pressure of the opposing fluid. This prevents a large pressure differential across the diaphragm, which, if uncontrolled, could cause it to burst. A second reason is to vary the pressure on the opposing side in concert with the action of the engine's throttle control. That is, as working fluid pressure is raised and lowered, the same is done with the opposing fluid, to avoid doing unwanted work on the gas in the opposing chamber and to protect the diaphragm.

The working fluid pressure is controlled as a means of throttling the engine. As more working fluid is forced into the engine, by increasing its pressure with the control system, the engine will increase its power output, because the greater volume of working fluid will transfer more heat into and out of the engine cycle and thus do more work. Reducing the pressure will have the opposite effect. In this way, engine output can be continuously varied, to match the load conditions.

In displacer type engines, in order to force the greatest possible percentage of the working fluid in the engine to participate effectively in the thermodynamic process, as much fluid as possible must be swept alternatively all the way through the engine, from hot side to cold side and back again. This is obtained by making the volume of the displacer very large in comparison to the rest of the volume of the engine. This ensures that the vast majority of working fluid contributes effectively to the process.

The working fluid moves between the hot and cold chambers of the cylinders in a closed fluid path. A closed fluid path means that during normal operation, fluid reciprocates between the chambers, compared to a internal combustion engine, for example, which continually intakes combustion air and exhausts combustion byproducts to the atmosphere. The closed fluid path in the present invention does allow for the introduction of additional working fluid when necessary and for pressure.

A pressure differential is maintained between the working fluid and the opposing fluid in the first cylinder of between 5 to 35 psi. By maintaining pressurized opposing fluid, a higher working fluid pressure is possible while maintaining the integrity of the diaphragm. In addition, the opposing fluid aids in the compression stroke by reducing the work necessary to compress the working fluid. However, the pressure of the opposing fluid is not so high that it interferes with the power stroke. Preferably, the opposing fluid pressure is maintained between the minimum and maximum working fluid pressure. Ideally, the opposing fluid pressure is maintained at the mean of the minimum and maximum working fluid pressure. The externally heated engine may have the working fluid at a pressure of below 10 atmospheres. The externally heated engine may have the working fluid at a pressure of greater than 60 PSI.

A regenerator is provided within the closed fluid path. The regenerator is a temporary repository of heat during certain cycles of the engine. Because the temperatures are lower than in engines of the prior art, the present invention may employ a shell made out of polytetrafluoroethylene material. This material does not conduct heat. Thus there is no thermal short circuit around the mesh. In prior art regenerators operating at extremely high temperatures, only all-metallic internal components could be used. Since each layer of such metallic mesh touched both adjacent layers, a continuous, thermally conductive path was established from the hot side of the regenerator to the cold side. This resulted in a continuous loss of high temperature energy over to the cold side.

In the present invention, the regenerator operates at low enough temperatures to allow the introduction of non-metallic layers of mesh. Preferably, non-metallic mesh layers are used after every 10 or so metal layers. These non-conductive layers break up the conductive path, and thus prevent the unwanted loss of energy from the hot side to the cold side of the regenerator. In addition, since the non-metallic mesh layers can be made, for example, of woven fiberglass, they have enough thermal capacity to add slightly to the heat retention capacity of the regenerator, further adding regenerating action without adding unwanted, unswept volume.

Preferably, in addition to the metallic mesh layers and insulating mesh layers in the regenerator, a third type of layer is used. Specifically, a thicker, copper layer, which is solid with a pattern of larger openings can be used. The openings are arranged to break up and redistribute the air flow within the regenerator to ensure that the entire mesh content is fully utilized efficiently. The thicker copper also retains some additional heat, which adds further to the regenerating capacity. The regenerator does not need stainless steel wire in the mesh as with prior art regenerators, but may include copper wire, which is far more thermally conductive than steel. Silver may be used as an alternative to copper, for even higher performance. The copper mesh may be coated with diamond and may include a high melting point thermal insulating polymer such as polytetrafluoroethylene in the form of an outer cylinder and a center core. The regenerator may include a perforated disk constructed from a diamond copper composite. These choices allow the use of less mesh, with a consequent reduction in pumping losses. Alternatively, a regenerator with a series of tube segments separated by insulating material, such as, for example, fiber glass can be used. The tubes could be, for example, copper, silver, diamond coated metal, or combinations thereof.

The engine operates in the following manner. The heat applied to the hot side causes the working fluid, such as air, methane or another gas, to rise in pressure, and to expand. This forces the piston to move, thus doing useful work. The working fluid is then passed through the regenerator, on its way to the cold side. In the process it leaves behind much of its heat, which is temporarily stored in the regenerator mesh matrix. The fluid thus arrives in the cold side much reduced in temperature.

Once in the cold side, the fluid is compressed back to its original, smaller volume. This requires the removal of some heat, which is preferably rejected to a recuperator. This heat is thus recovered and reused.

Finally, the fluid passes back through the regenerator to the hot side. On the way it picks up the heat left behind in the regenerator mesh matrix. The fluid thus arrives in the hot cylinder at a much increased temperature and pressure. As further heat is added through the hot heat injector or exchanger, the fluid again enters an expansion process, thus beginning a new cycle of the engine. The piston and the displacer are arranged to reciprocate such that the volume of the working fluid is compressed and expanded alternately.

The externally heated engine may include a diaphragm attached to the piston to create a seal between the piston and the cylinder. The diaphragm may be a two layers of thin rubber separated by a woven mesh layer to increase the strength of the diaphragm. This diaphragm has virtually zero friction and zero break-away force. The diaphragm has a low melting temperature. Leakage is so slow as to be negligible. The unit is low cost, and will give up to a billion cycles in service.

The reason such a diaphragm can be employed in an externally heated engine is because of low temperature and pressure in the present invention. Without this, the high temperatures and pressures make the use of a diaphragm impractical. In prior art designs, a diaphragm would have to be made partly of thin, high temperature metals, with heat shielding. This would greatly increase friction and reduce service life, negating advantages of the diaphragm.

However, with the present invention, the diaphragm makes it possible to eliminate the main source of friction in the engine. That is, the piston rings are eliminated. A prior art Stirling engine will lose at least 20% of its output power to friction. The great majority of this friction is eliminated with the present invention. The diaphragm also eliminates the problem of leakage which is present with traditional piston ring seals. Because there is no leakage, the working fluid and opposing fluid do not mix, so that the working fluid does not become contaminated by the opposing fluid if those two fluids are not the same. The working fluid and opposing fluid need not be the same because of the perfect seal provided by the diaphragm. An opposing fluid such as dry nitrogen could be used, for example, to avoid oxidation and contamination of the volume enclosed in the bonnet. In addition, a light gas, such as helium, may be used as the working fluid, to obtain thermodynamic benefits, while still using a heavy gas such as air or nitrogen as the opposing fluid, thus avoiding the expense and difficulty of sealing the lighter gas on the opposing side, or providing quantities of it to make up for leakage.

Additionally, with the diaphragm, there is no need for lubrication in the cylinders, because the diaphragm is essentially frictionless. By eliminating lubricating oil, the working fluid does not become contaminated with lubricant.

In one embodiment of the engine, a piston is adapted for movement within a first cylinder. The piston has a first side and a second side opposite the first side. The first side and the first cylinder define a working chamber and the second side and the first cylinder define an opposite chamber containing an opposing fluid. A displacer is adapted for movement within a second cylinder. The displacer has a first side and a second side opposite the first side. The first side of the displacer and the second cylinder define a cold chamber and the second side of the displacer and the second cylinder define a hot chamber. There is a closed fluid path between the first and second cylinders which includes a working fluid. The working fluid is capable of moving between the working chamber, the cold chamber and the hot chamber. A regenerator is located within the closed fluid path. A heat source is provided for heating the working fluid. A source of cold could also be provided to cool the working fluid. A link is provided to cause reciprocation of the piston.

In some embodiments, a first disk is connected to a first shaft section and a second disk is connected to a second shaft section. A yoke can be connected to the first disk and the second disk and could be adapted for positional adjustment in the radial direction with respect to the first disk and the second disk. Preferably, the link is connected to the yoke such that positional adjustment of the yoke causes the position of the piston to change within the cylinder.

Preferably, the first cylinder has a first cylinder section and a second cylinder section, the first cylinder further includes a piston disk and a spacer disk. The piston is connected to the piston disk and the spacer disk is adapted to be attached between one of the first cylinder section and the piston disk and the second cylinder section and the piston disk. Preferably, there is a gasket adjacent the spacer disk. Additional spacers and gaskets could be used as needed. By placing spacers on one side or the other of the piston disk, the position of the diaphragm changes inside the cylinder, and thus the distance the diaphragm can travel before it hits top dead center changes. By changing the stroke of the piston, the amount of swept volume changes. Because the remainder of the volume of the engine is fixed, changing the position of the diaphragm changes the compression ratio of the engine, which is useful to accommodate various temperatures of the heat source for the engine.

In some embodiments, a displacer link is adapted to cause reciprocation of the displacer. The displacer link is connected to a displacer link disk. The displacer link disk is connected to a first shaft section and the piston link disk is connected to a second shaft section. The first shaft section and the second shaft section operably connected to each other. One of the shaft sections is operatively connected to a first disk and a second disk. The angular position of the first disk with respect to the second disk is adjustable. By adjusting the angular position of the first disk with respect to the second disk, the relative position of the displacer with respect to the piston changes. Depending on the temperature, pressure, revolutions per minute and other engine conditions, adjustment of the angular position can be used to optimize engine performance. In one embodiment, the first disk and the second disk include a plurality of bores and further include pins adapted to be inserted in the bores to fix the position of the first disk with respect to the second disk. In addition, threaded bores could be used for accepting bolts inserted through bores in at least one of the first disk and second disk.

In some embodiments, the displacer link is moved by a displacer cam assembly. The displacer cam assembly includes a first cam and a second cam. The first cam and the second cam each have a groove therein with a groove path. The displacer link is adapted to follow the groove path of the first cam and the second cam. The grove path in each of the first cam and the second cam varies in distance from the center of each cam. The displacer link can be connected to a pin and the pin can be inserted into the groove of each of the first cam and the second cam. In engines of the past, rotating crank disks impart a sinusoidal motion to the displacer. The cam assembly of the present invention can be configured to cause the displacer to dwell at the two ends of the stroke and to move rapidly from one end to the other. Preferably, the groove path has a first section which is at constant distance from the center of the cam. The groove path has a second section which is also at a constant distance from the center of the cam. The groove path makes a rapid transition between these two sections. When the pin is in each section of constant diameter, the displacer dwells at the ends of the stroke. When the pin is in the transition between these two sections, the displacer moves rapidly from one end point to the other. When the displacer dwells at the ends of its stroke, the thermodynamic cycle is squared off. By dwelling with the gas trapped in the hot end of the engine, during most of the power stroke, the gas is held as closely as possible to the ideal of an isothermal expansion with heat addition. Similarly, by causing the gas to dwell in the cold end during substantially the entire compression stroke, this part of the cycle approaches the ideal of an isothermal compression, with the heat of compression being removed.

In some embodiments, the displacer cold chamber includes a cooling element attached to the external surface of the cold chamber, which helps extract the heat of compression. In some embodiments, the displacer hot chamber includes a heating element attached to the external surface of the hot chamber, which helps replace the heat of expansion. Both the surface heating and cooling elements do not add any dead volume to the engine.

BRIEF DESCRIPTION OF THE DRAWINGS

The present invention will now be described, by way of example, with reference to the accompanying drawings, in which.

DESCRIPTION OF THE PREFERRED EMBODIMENTS

Figures 5, 6:
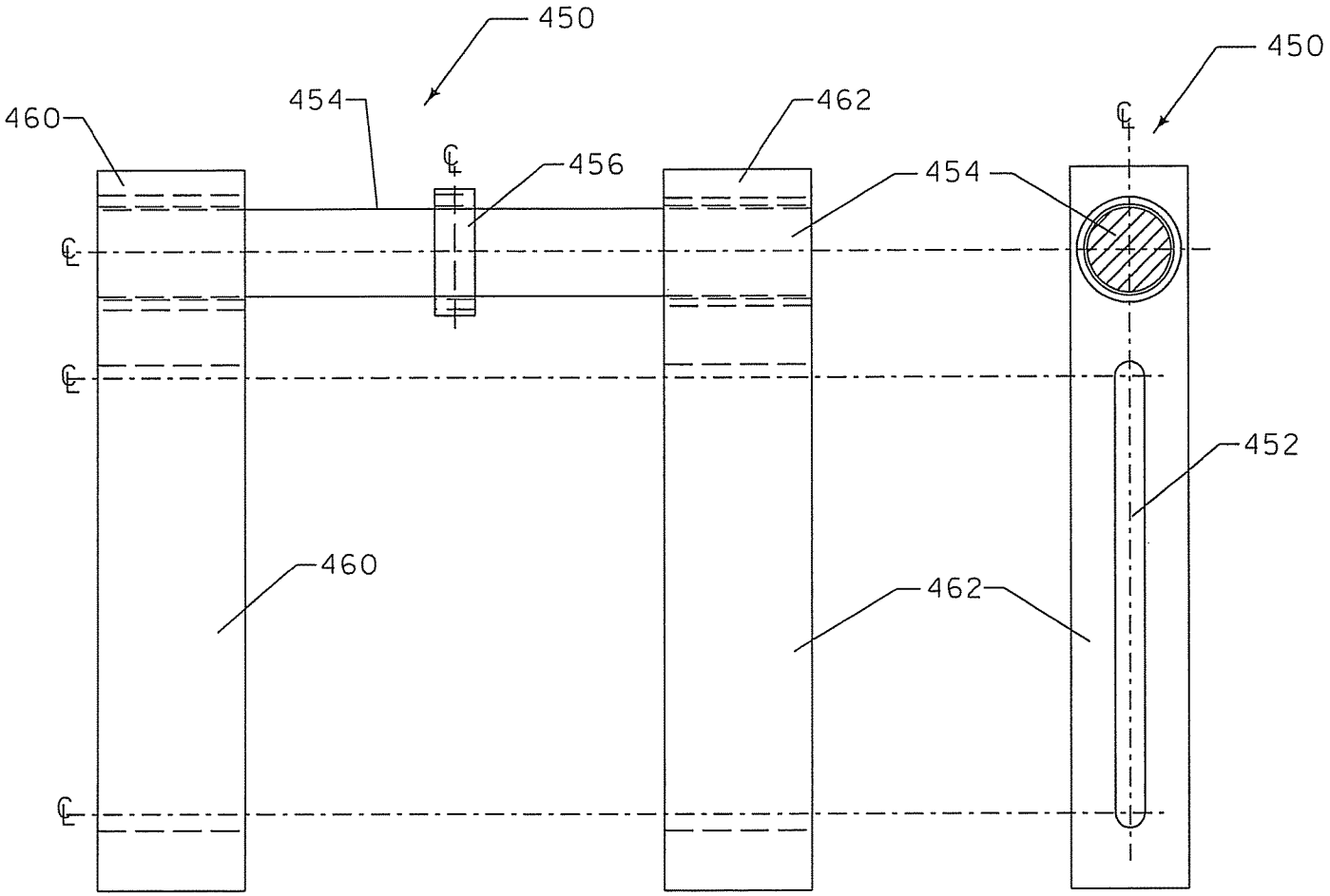
FIG. 5 is a front elevation view of a portion of the stroke adjustment device of FIG. 2.
FIG. 6 is a side elevation view of the device of FIG. 5.
Figure 7:
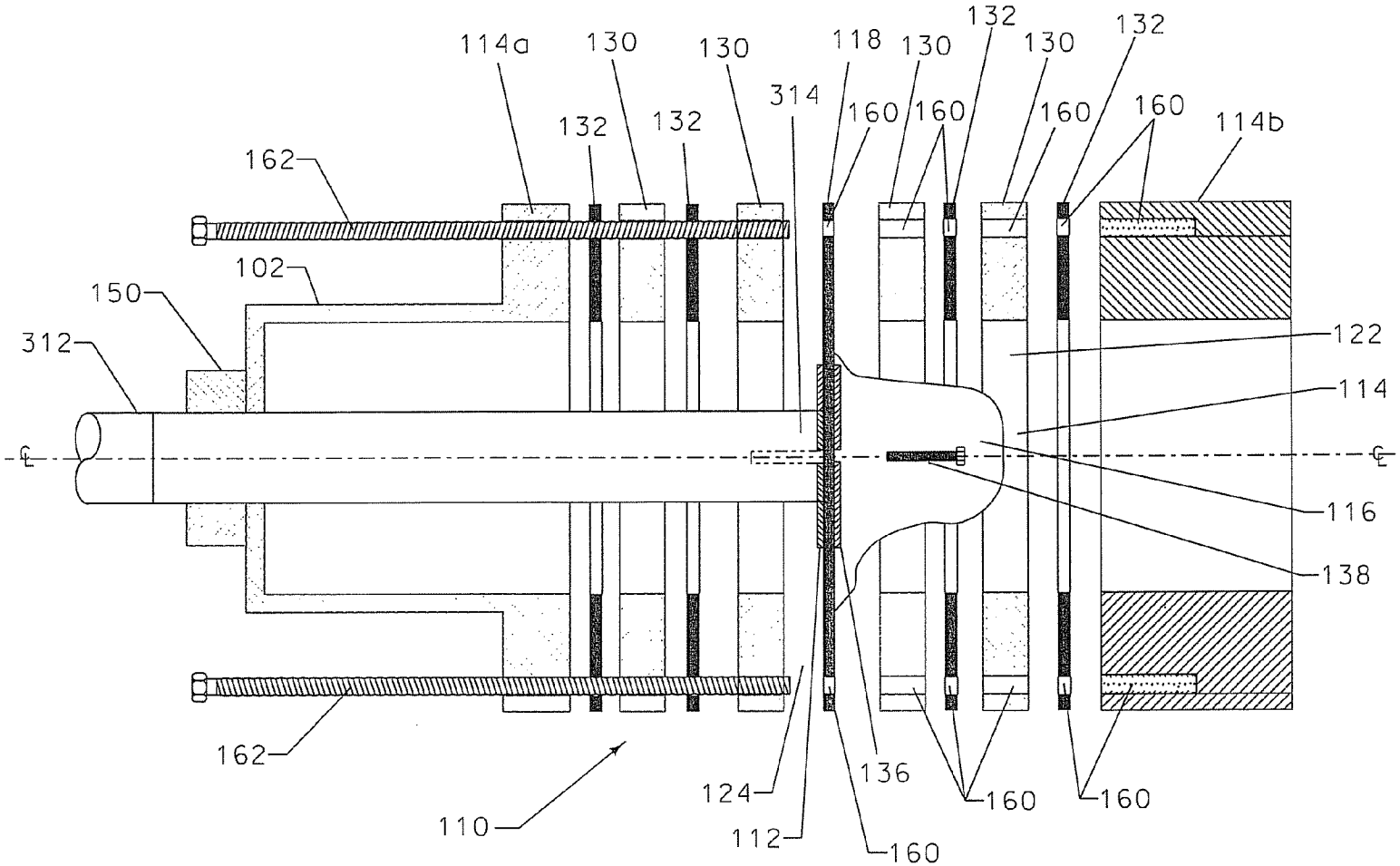
FIG. 7 is an exploded cross-sectional view of the piston and cylinder of the present invention.
Figure 8:
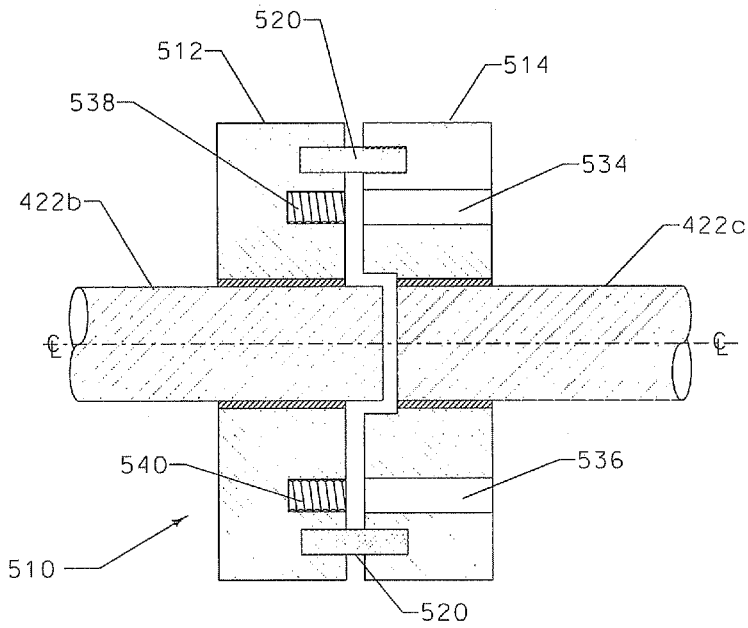
FIG. 8 is a cross-sectional view of a timing adjustment device of the present invention.
Figure 9:
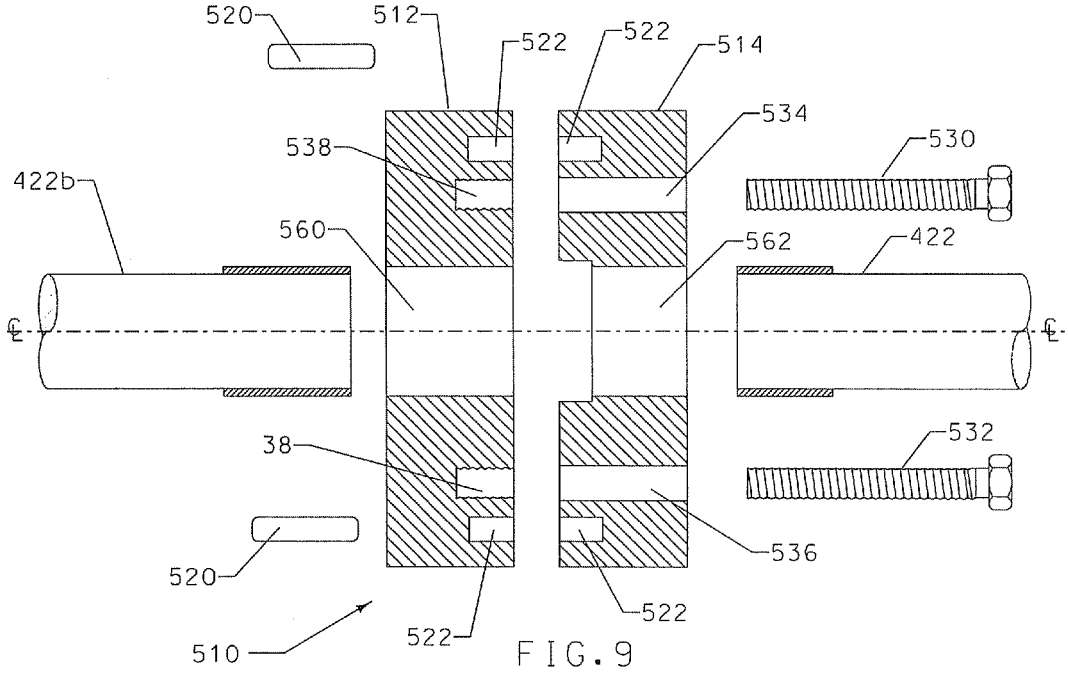
FIG. 9 is an exploded cross-sectional view of the timing adjustment device of FIG. 8.
Figure 10:
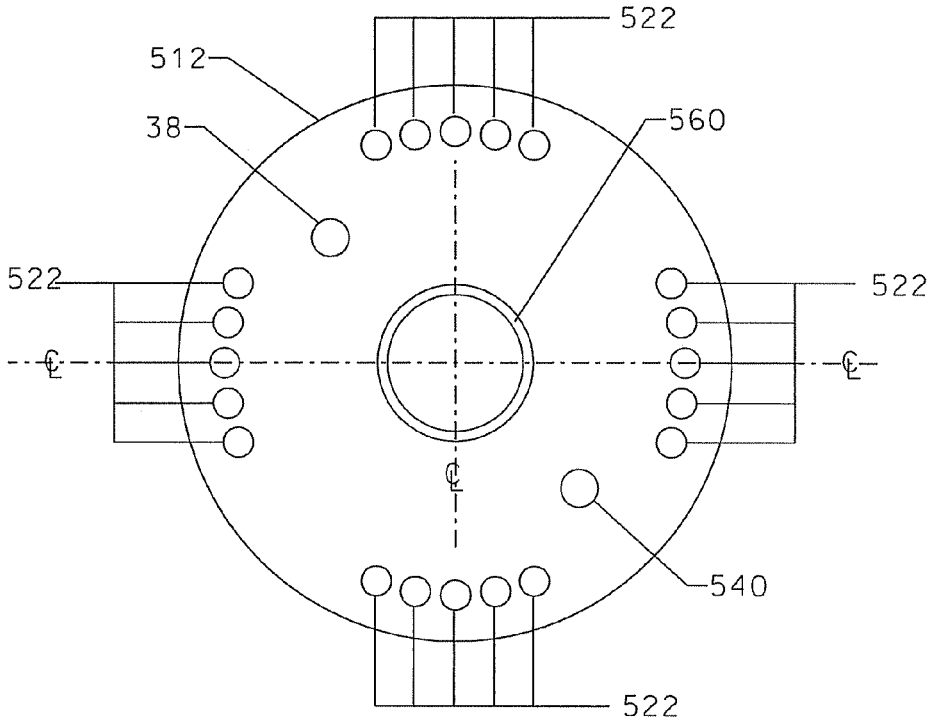
FIG. 10 is a front elevation view of a portion of the timing adjustment device of FIG. 8.
Figure 11:
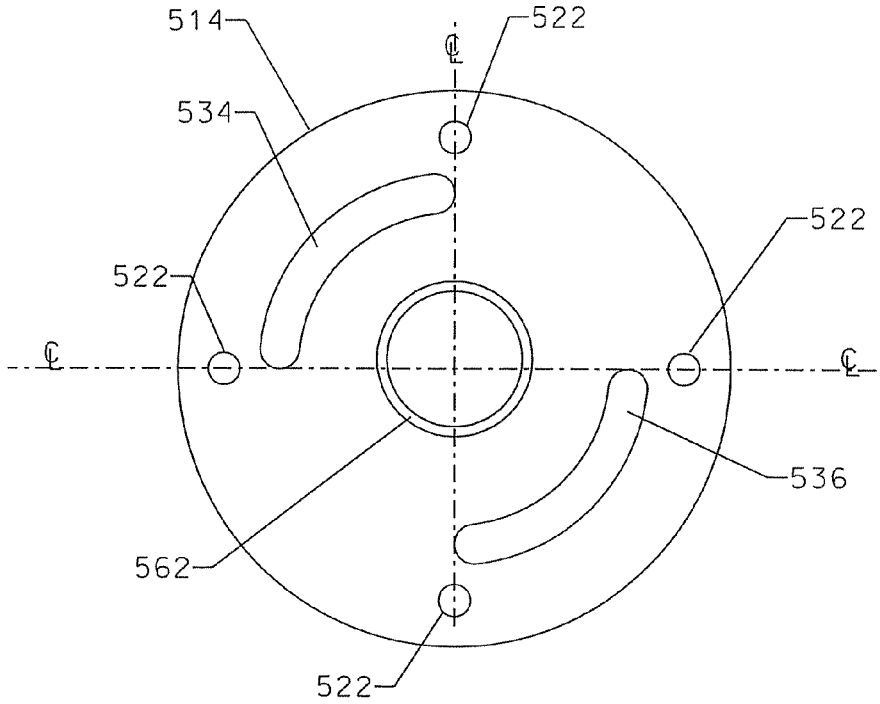
FIG. 11 is a front elevation view of another portion of the timing adjustment device of FIG. 8.
Figure 12:
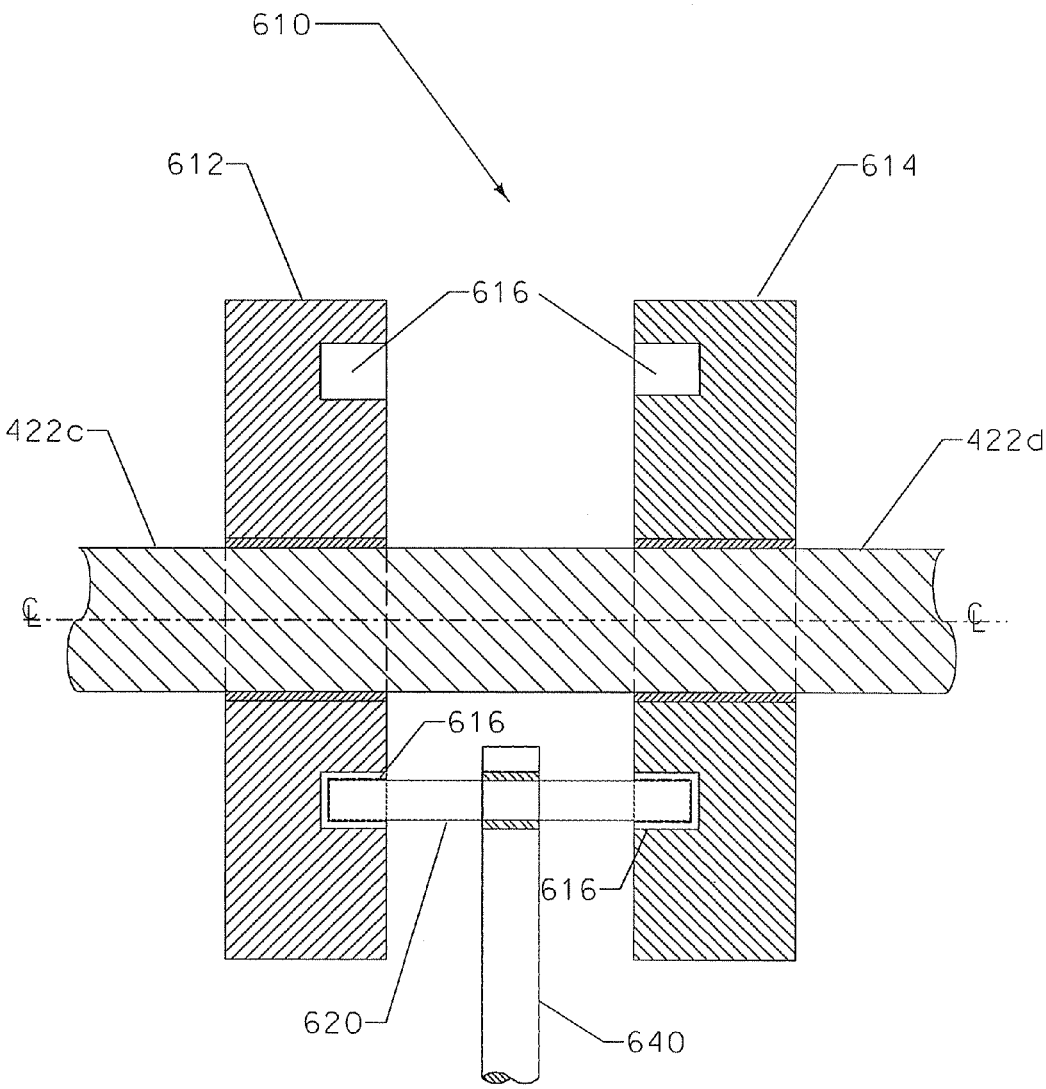
FIG. 12 is a cross-sectional view of the stroke timing adjustment device of the present invention.

FIGS. 1 through 14 show the present invention. More specifically, referring to FIG. 1 a conceptual overview of the present invention is shown. A piston and displacer assembly 100 is provided which generates power. The piston assembly 110, which is shown in greater detail in FIG. 7 includes a piston 112 which is mounted for reciprocation in cylinder 114. At the end of the piston 112 is a diaphragm 116. Diaphragm 116 is held in place by diaphragm disk 118. The diaphragm 116 defines the border between the working chamber 122 and the opposing chamber 124. The piston rod 312 facilitates reciprocation of the piston 112 and is held in proper orientation by bearing 150. As piston 112 reciprocates in cylinder 114, the diaphragm 116 moves within the cylinder 114. The diaphragm 116 is attached to the front surface 136 of a piston 112 by any suitable means, such as, for example, bolt 138 and washer (not shown). The diaphragm 116 forms a frictionless seal between the working chamber 122 and the opposing chamber 124. The piston 112 is contained in a bonnet or cylinder housing 102. FIG. 7 shows a cross-sectional view of the piston assembly 110.

Pushrod 312 is attached one end 314 to piston 112 and at the other end 316 to slider assembly 320. Slider assembly 320 is adapted for linear movement. Link 322 is pivotally connected to slider assembly 320 and allows for the conversion of linear motion to rotational motion. Bearings 326 guide the movement of pushrod 312.

Figure 1:
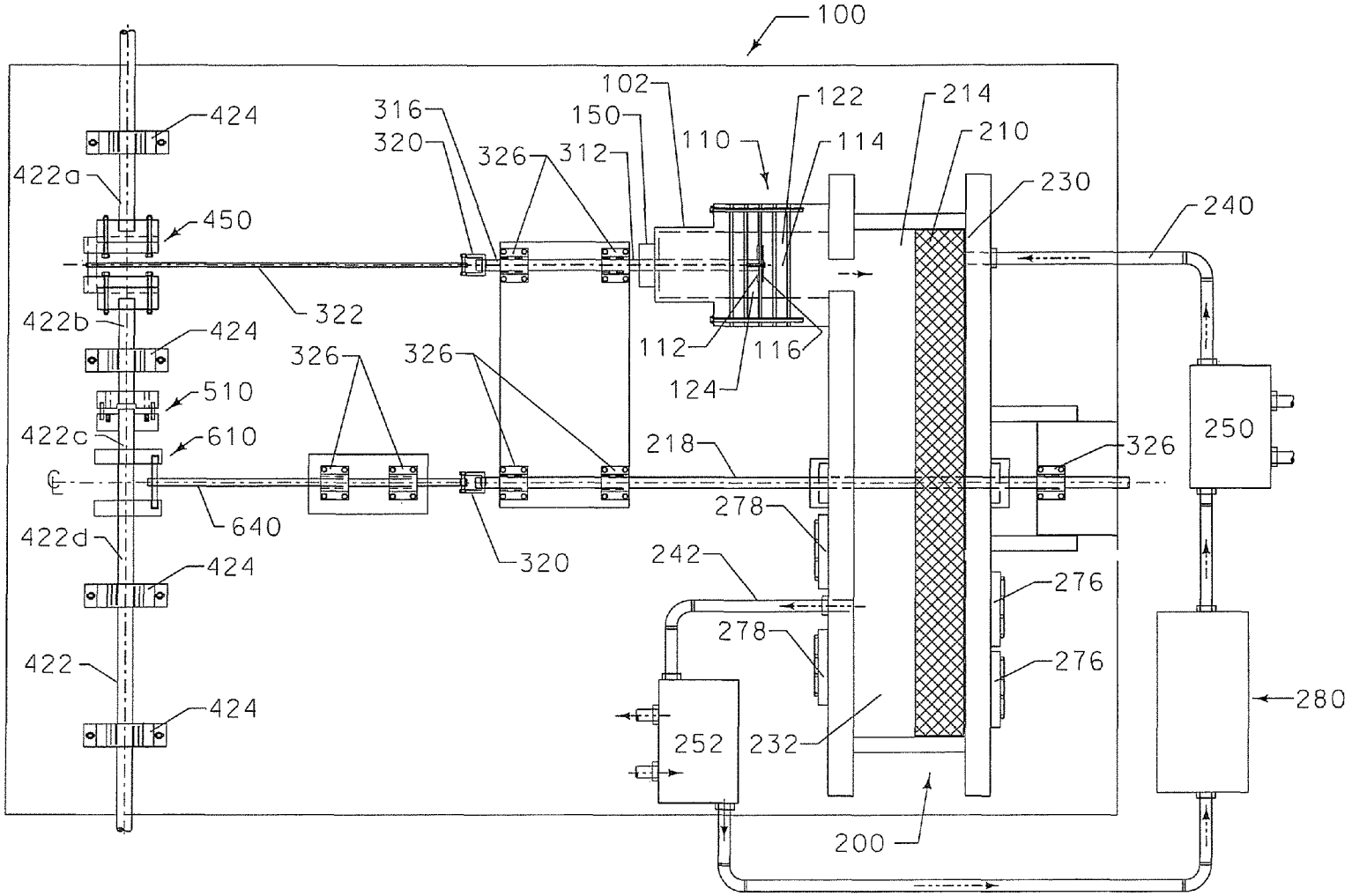
FIG. 1 is a simplified conceptual view of an engine used in connection with the present invention.
Figure 2:
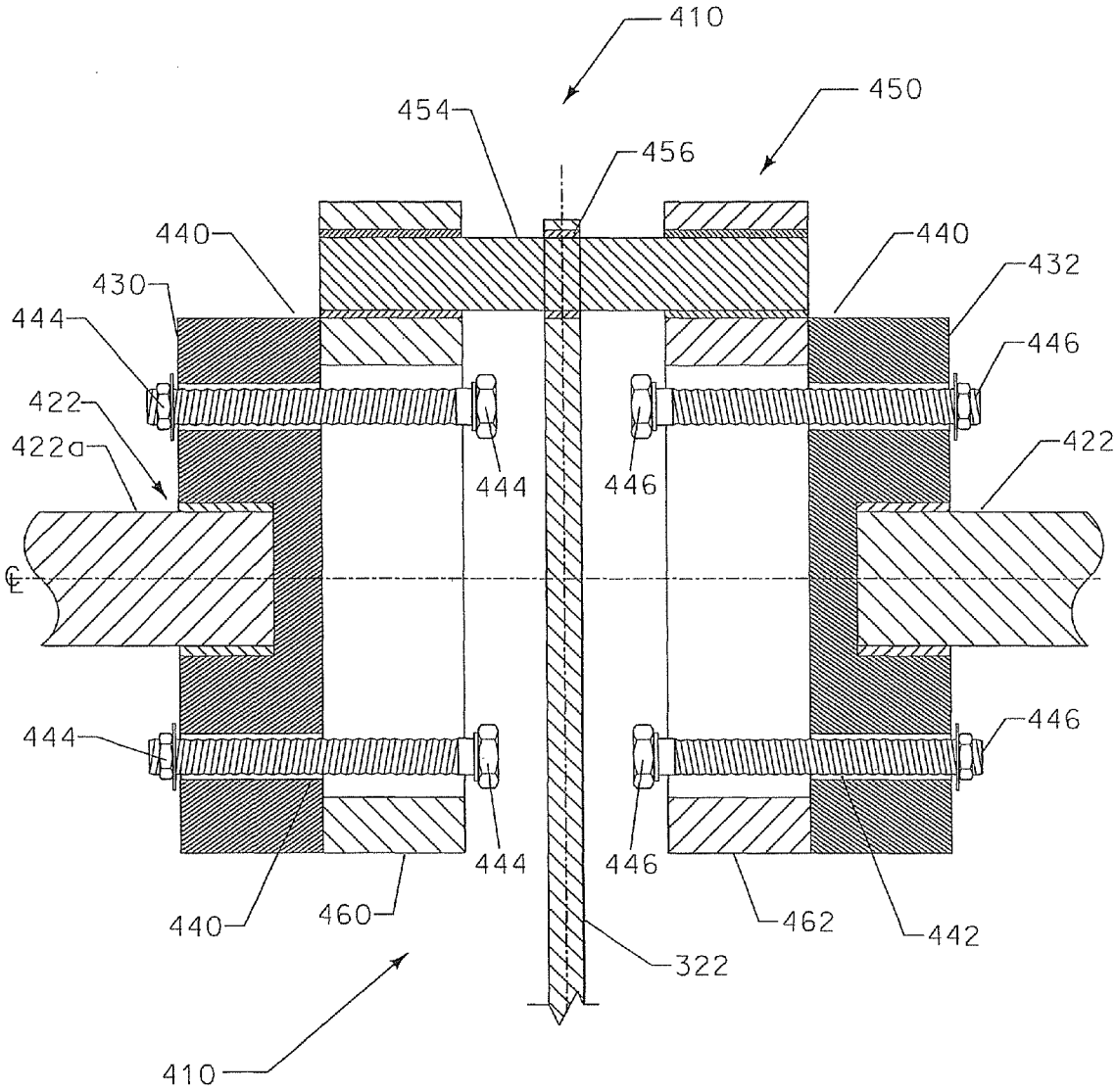
FIG. 2 is a cross-sectional view of the stroke adjustment device of the present invention.
Figure 4:
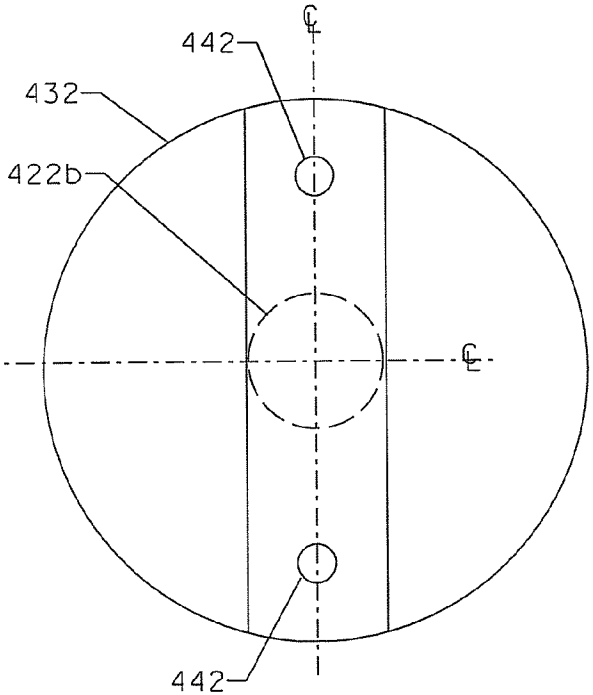
FIG. 4 is an end view of the device of FIG. 3.
Figure 3:
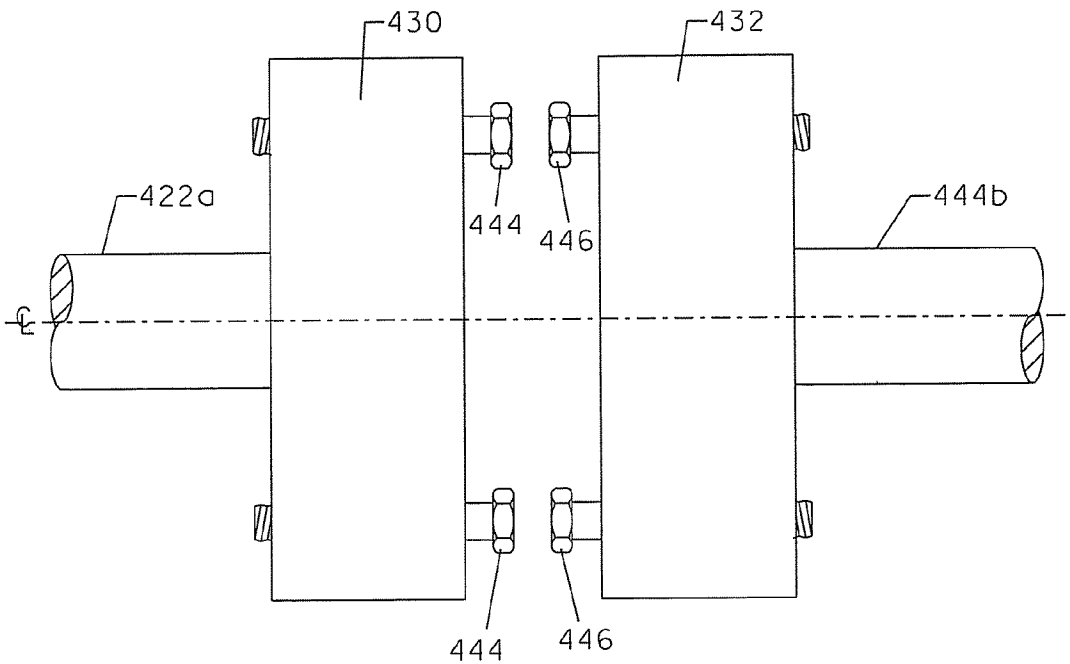
FIG. 3 is a front elevation view of a portion of the stroke adjustment device of the prevent invention.

As shown in FIGS. 1 and 2 the link 322 is connected to a disk assembly 410 mounted to the crankshaft 422. The crankshaft 422 is supported by bearings 424. The crankshaft 422 is split into multiple sections, two of which, 422*a* and 422*b*, are shown in FIG. 2. The disk assembly 410 includes a novel mounting arrangement for the link 322 to allow for adjustment of the position of the piston 112, shown in FIGS. 2-6. The link 322 is attached to attachment bar 454 by clamp 456. The disk assembly 410 includes a first disk 430 and a second disk 432. The crankshaft section 422*a* is connected to the first disk 430. The first disk 430 includes bolt holes 440. The second disk 432 is connected to the crankshaft section 422*b* and includes bolt holes 442. A U-shaped adjustment yoke 450 is attached to the first disk 430 and the second disk 432 by bolts 444 and 446. As shown in FIG. 6 the yoke 450 has slots 452. The bolts 444 and 446 pass through the slots 452 so that the yoke 450 can be adjusted in the vertical direction as seen in FIG. 2. Attachment bar 454 is provided between legs 460 and 462 of the yoke 450. The attachment bar 454 can be slid up and down by loosening the bolts 444 and 446. As the attachment bar 454 is located further away from the crankshaft 422, the position of the link 322 with respect to the cylinder 114 is changed.

As the position of the link 322 is changed, the position of the piston 112 in the cylinder 114 must also be changed. The cylinder 114 is designed so that the location of the piston 112 can be changed with respect to the cylinder 114. As shown in FIG. 7, the cylinder 114 has a first end piece 114*a* and a second end piece 114*b*. Between the first end piece 114*a* and the second end piece 114*b* are a number of spacers 130 and gaskets 132. The first end piece 114*a*, the second end piece 114*b*, the spacers 130 and the gaskets 132 all have bores 160 there through to accept bolts 162. The pushrod 312 enters the first end piece 114*a* through a bearing 150. At the terminal end of the pushrod 312, the disk 118 holds the diaphragm 116 in place within the cylinder 114. By moving spacers 130 and gaskets 132 from one side of the disk 118 to the other, the position of the disk 118, and thus the diaphragm 116 is changed with respect to the cylinder 114, effectively changing the stroke length of the piston 112. Changing the stroke of the piston 112 changes the compression ratio of the engine.

Figure 14:
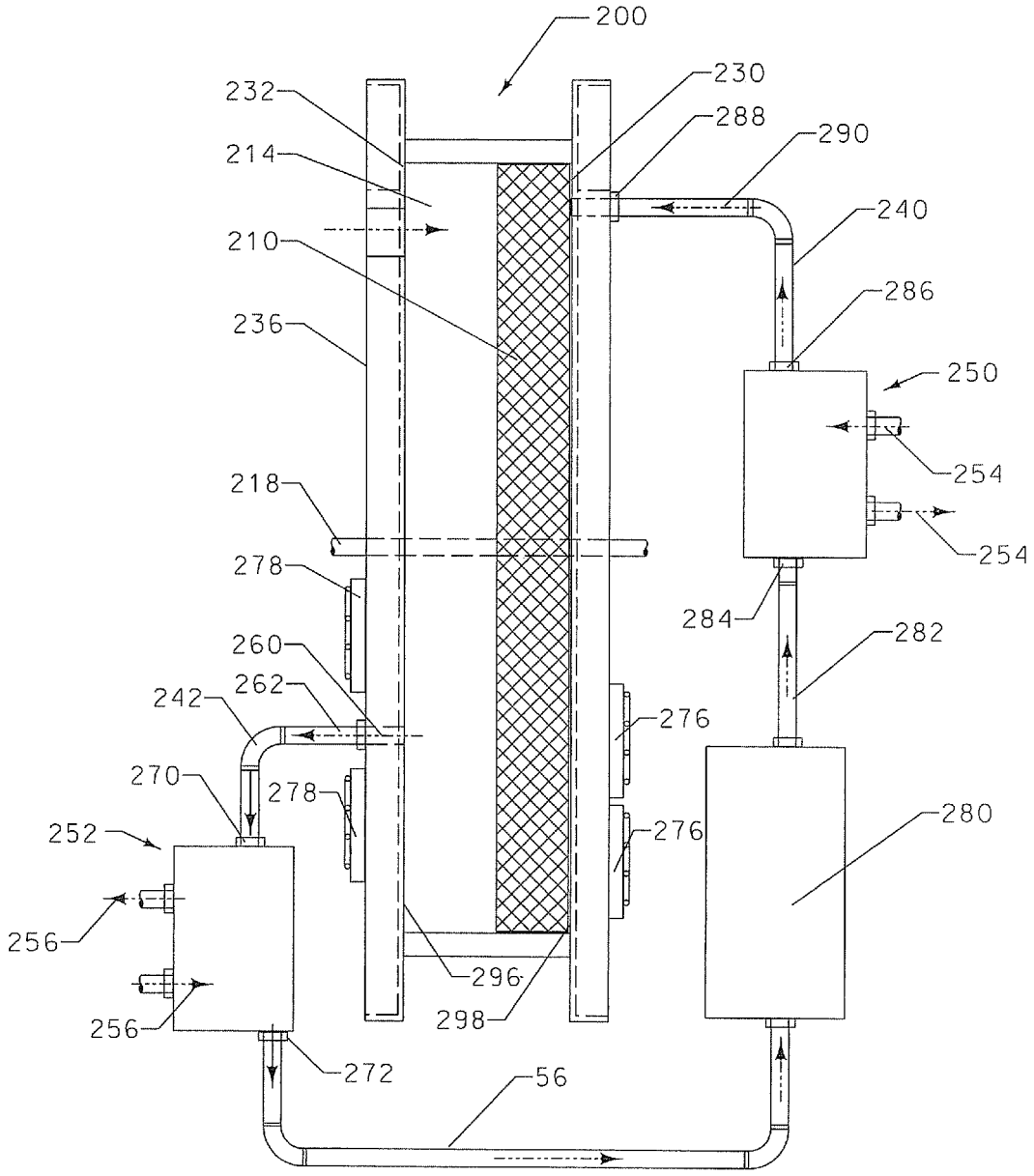
FIG. 14 is a simplified conceptual view of the displacer assembly of the present invention.

As seen in FIGS. 1 and 14, the engine includes a displacer or shuttle 210, which is moved alternatively back and forth in its cylinder 214 by pushrod 218. The displacer 210 moves the working fluid alternatively from the hot end 230 to the cold end 232. Conduits 240 and 242 connect the displacer cylinder hot end 230 and cold end 232 to the heat injector 250 and the heat extractor 252. Working fluid represented by arrows 254 circulates through the heat injector 250. Cooled fluid represented by arrows 256 circulates through the heat extractor 252. FIG. 14 illustrates, in simplified schematic form, the flow of fluid through the displacer assembly 200 of the engine. Working fluid leaves the cold side 232 of the displacer assembly 200 through the nozzle 260 as represented by the arrow 262 and enters the heat exchanger 252. Heated fluid circulates in the heat exchanger 252 by entering the nozzle 270 and exiting the nozzle 272. As is known in the art, the heated fluid and the working fluid are isolated from one another and do not mix. The working fluid passes through the regenerator 280 and transfers heat to the regenerator 280. The working fluid then passes to the cold heat exchanger 250 as illustrated by arrow 282. Working fluid enters the cold heat exchanger at nozzle 284 and exits at nozzle 286. Again, the cold fluid and the working fluid do not mix. The working fluid enters the displacer cylinder 214 at nozzle 288 as illustrated by arrow 290. As the displacer 210 moves in the opposite direction, the working fluid flow reverses and the process repeats. Heating elements 276 are attached to the outer surface 234 of the hot end 230. Cooling elements 278 are attached to the outer surface 236 of the cold end 232.

FIGS. 8-11 show a timing adjustment assembly 510. The crankshaft section 422*b* and crankshaft section 422*c* are part of the timing adjustment assembly 510. The crankshaft section 422*b* is connected to a first disk 512 in bore 560. The crankshaft section 422*c* is connected to a second disk 514 in bore 562. Pins 520 and bores 522 are provided to rotationally fix the first disk 512 to the second disk 514. Bolts 530 and 532 are inserted through bores 534 and 536 respectively to also fix the first disk 512 with respect to the second disk 514. The bolts 530 and 532 are threaded into bores 538 and 540 respectively. When the pins 520 and bolts 530 and 532 are removed from disks 512 and 514, the first disk 512 can be rotated with respect to the second disk 514. The new position of the first disk 512 with respect to the second disk 514 is then fixed by pins 520 and bolts 530 and 532. Because shaft section 422*b* and the shaft section 422*c* form a single shaft 422, the lateral position of the displacer 210 will be changed with respect to the lateral position of the piston 112 when the rotational position of the first disk 512 is changed with respect to the rotational position of the second disk 514.

Figure 13A:
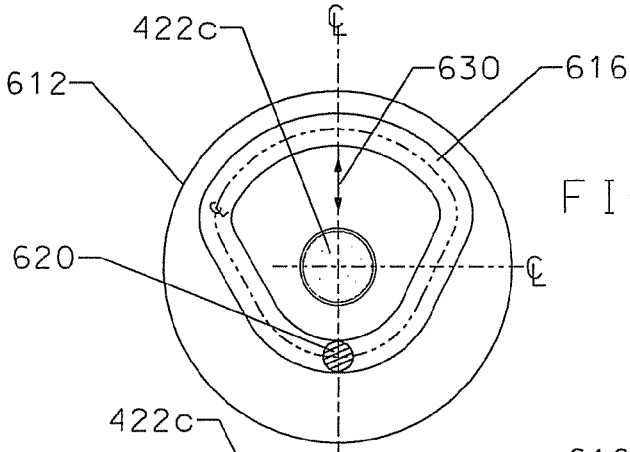
FIG. 13*a* is a cross-sectional view of a portion of the stroke timing adjustment device of FIG. 12 shown in a first position.
Figure 13B:
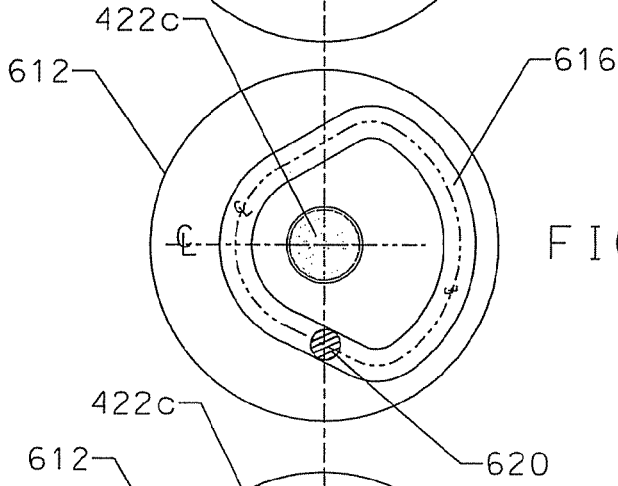
FIG. 13*b* is a cross-sectional view of a portion of the stroke timing adjustment device of FIG. 12 shown in a second position.
Figure 13C:
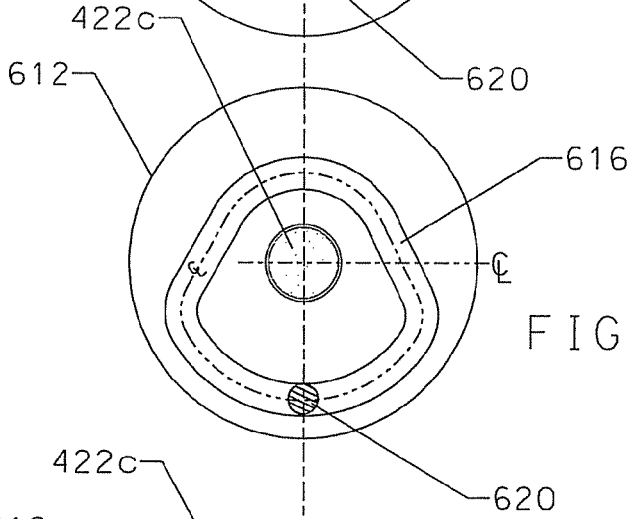
FIG. 13*c* is a cross-sectional view of a portion of the stroke timing adjustment device of FIG. 12 shown in a third position.
Figure 13D:
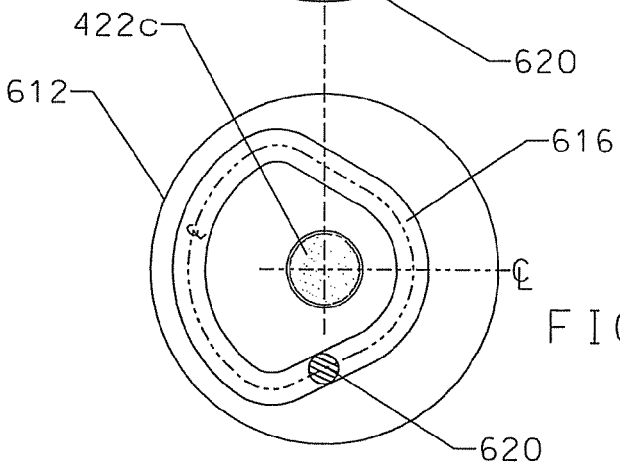
FIG. 13*d* is a cross-sectional view of a portion of the stroke timing adjustment device of FIG. 12 shown in a fourth position.

FIGS. 12 and 13*a*-13*d* illustrate the displacer 210 reciprocation cam assembly 610. The crankshaft section 422*c* has a cam 612 attached thereto. Similarly, the crankshaft section 422*d* has a cam 614 attached thereto. Each cam 612 and 614 has a groove 616 as best seen in FIGS. 13*a*-13*d*. A pin 620 is inserted into the groove of each disk 612 and 614. As the disks 612 and 614 rotate the pin 620 is moved radially in the direction of arrow 630 in FIG. 13*a*. The link 640 for the displacer 210 is connected to the pin 620. As the radial position of the pin 620 changes, this determines the lateral position of the link 640 for the displacer 210 and, thus, the lateral location of the displacer 210. When the pin 620 is located at a point closest to the crankshaft 422, the displacer 210 is at one end of its reciprocating path. When the pin 620 is located at a point farthest from the crankshaft 422, the displacer 210 is located at the other end of its reciprocating path. FIGS. 13*a*-13*d* illustrate the radial position of the pin 620 for various positions of the cam. In FIG. 13*a*, the pin 620 is located nearest to the crankshaft 422. As the cam 612 rotates to the position shown in FIG. 13*b*, the pin 620 is moved radially outward. As the cam 612 continues to rotate, the pin 620 is moved to the position in FIG. 13*c*, which is farthest from the crankshaft 422. Finally, as the cam 612 rotates to the position in FIG. 13*d*, the pin 620 is moved closer to the crankshaft 422. The shape of the slot 616 determines the amount of time that the displacer 210 dwells at its end points 296 and 298 (FIG. 14), and the speed at which the displacer 210 moves from one end 296 of the cylinder 214 to the other 298. By causing the displacer 210 to dwell at the ends of its reciprocating path, and to move rapidly from end to end, the heat transfer to and from the working fluid is enhanced.

One of ordinary skill in the art will appreciate that there are many equally feasible power transmission methods and physical arrangements of the various elements described. The foregoing description is meant to provide a conceptual overview and should not be viewed as limiting the invention. While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An externally heated engine comprising:

a) a piston adapted for movement within a first cylinder, said piston having a first side and a second side opposite the first side, the first side and the first cylinder defining a working chamber and the second side and the first cylinder defining an opposite chamber containing an opposing fluid;

b) a displacer adapted for movement within a second cylinder, said displacer having a first side and a second side opposite the first side, the first side of the displacer and the second cylinder defining a cold chamber and the second side of the displacer and the second cylinder defining a hot chamber;

c) a closed fluid path between the first and second cylinders, the closed fluid path including a working fluid, the working fluid capable of moving between the working chamber, the cold chamber and the hot chamber;

d) a regenerator within the closed fluid path;

e) a heat source for heating the working fluid;

f) a link adapted to cause reciprocation of the piston;

g) a first disk connected to a first shaft section;

h) a second disk connected to a second shaft section;

i) a yoke connected to the first disk and the second disk, the yoke adapted for positional adjustment in the radial direction with respect to the first disk and the second disk;

j) the link connected to the yoke such that positional adjustment of the yoke causes the position of the piston to change within the cylinder.

2. The externally heated engine of claim 1 further including a cold source for cooling the working fluid.

3. The externally heated engine of claim 1 wherein the first cylinder has a first cylinder section and a second cylinder section, the first cylinder further including a piston disk and a spacer disk wherein the piston is connected to the piston disk and the spacer disk is adapted to be attached between one of the first cylinder section and the piston disk and the second cylinder section and the piston disk.

4. The externally heated engine of claim 3 further including gasket adjacent the spacer disk.

5. The externally heated engine of claim 4 further including a second spacer disk and second gasket between the first cylinder section and the second cylinder section.

6. An externally heated engine comprising:

a) a piston adapted for movement within a first cylinder, said piston having a first side and a second side opposite the first side, the first side and the first cylinder defining a working chamber and the second side and the first cylinder defining an opposite chamber containing an opposing fluid;

b) a displacer adapted for movement within a second cylinder, said displacer having a first side and a second side opposite the first side, the first side of the displacer and the second cylinder defining a cold chamber and the second side of the displacer and the second cylinder defining a hot chamber;

c) a fluid path between the first and second cylinders, the closed fluid path including a working fluid, the working fluid capable of moving between the working chamber, the cold chamber and the hot chamber;

d) a regenerator within the fluid path;

e) a heat source for heating the working fluid;

f) a piston link adapted to cause reciprocation of the piston, the piston link connected to a piston link disk;

g) a displacer link adapted to cause reciprocation of the displacer, the displacer link connected to a displacer link disk, the displacer link disk connected to a first shaft section and the piston link disk connected to a second shaft section, the first shaft section and the second shaft section operably connected to each other;

h) one of the first shaft section and the second shaft section operatively connected to a first disk and a second disk, wherein the angular position of the first disk with respect to the second disk is adjustable.

7. The externally heated engine of claim 6 further including a cold source for cooling the working fluid.

8. The externally heated engine of claim 6 wherein adjustment of the angular position of the first disk with respect to the second disk changes the relative position of the displacer with respect to the piston.

9. The externally heated engine of claim 8 wherein the first disk and the second disk include a plurality of bores and further including pins adapted to be inserted in the bores to fix the position of the first disk with respect to the second disk.

10. The externally heated engine of claim 9 further including threaded bores in at least one of the first disk and the second disk for accepting bolts inserted through bores in at least one of the first disk and second disk.

11. An externally heated engine comprising:

a) a piston adapted for movement within a first cylinder, said piston having a first side and a second side opposite the first side, the first side and the first cylinder defining a working chamber and the second side and the first cylinder defining an opposite chamber containing an opposing fluid;

b) a displacer adapted for movement within a second cylinder, said displacer having a first side and a second side opposite the first side, the first side of the displacer and the second cylinder defining a cold chamber and the second side of the displacer and the second cylinder defining a hot chamber;

c) a fluid path between the first and second cylinders, the closed fluid path including a working fluid, the working fluid capable of moving between the working chamber, the cold chamber and the hot chamber;

d) a regenerator within the fluid path;

e) a heat source for heating the working fluid;

f) a displacer link adapted to cause reciprocation of the displacer, the displacer link adapted to be moved by a displacer cam assembly;

g) the displacer cam assembly comprising a first cam and a second cam, the first cam and the second cam each having a groove therein with a groove path;

h) the displacer link adapted to follow the groove path of the first cam and the second cam.

12. The externally heated engine of claim 11 further including a cold source for cooling the working fluid.

13. The externally heated engine of claim 11 wherein the grove path in each of the first cam and the second cam varies in distance from the center of each cam.

14. The externally heated engine of claim 13 wherein the displacer link is connected to a pin and the pin is inserted into the groove of each of the first cam and the second cam.

* * * * *